US005189811A

United States Patent [19]

Rose et al.

[11] Patent Number: 5,189,811

[45] Date of Patent: Mar. 2, 1993

[54] METHOD AND ASSEMBLAGE FOR CONTROLLING AND MANAGING LOWER EXPLOSION LEVELS

[75] Inventors: James C. Rose, Fremont; Thomas P. DiNardo, Raleigh, both of N.C.

[73] Assignee: Merck & Co., Inc., Rahway, N.J.

[21] Appl. No.: 853,378

[22] Filed: Mar. 18, 1992

[51] Int. Cl.[5] ..... F26B 3/00

[52] U.S. Cl. ..... 34/29; 34/47; 34/72

[58] Field of Search ..... 34/27, 28, 32, 79, 26, 34/72, 47, 29

[56] References Cited

U.S. PATENT DOCUMENTS 3,868,779 3/1975 Wilt, Jr. et al. ..... 34/32
4,287,671 9/1981 Koch, II ..... 34/27 X
4,337,582 7/1982 Smith ..... 34/32
4,532,155 7/1985 Golant et al. .
4,663,859 5/1987 Hinson et al. .
4,942,676 7/1990 Wimberger et al. ..... 34/51

OTHER PUBLICATIONS

NFPA, Ovens and Furnaces, "NFPA 86 Standard for Ovens and Furnaces", 1985, Edition.

*Primary Examiner*—Henry Bennett
*Attorney, Agent, or Firm*—Salvatore C. Mitri; Charles M. Caruso

[57] ABSTRACT

There are disclosed a method and an assemblage for controlling and managing lower explosion levels of those products containing volatile or combustible materials which can create a potentially explosive or combustible atmosphere when such products are dried or subjected to further processing in an oven or furnace.

6 Claims, 1 Drawing Sheet

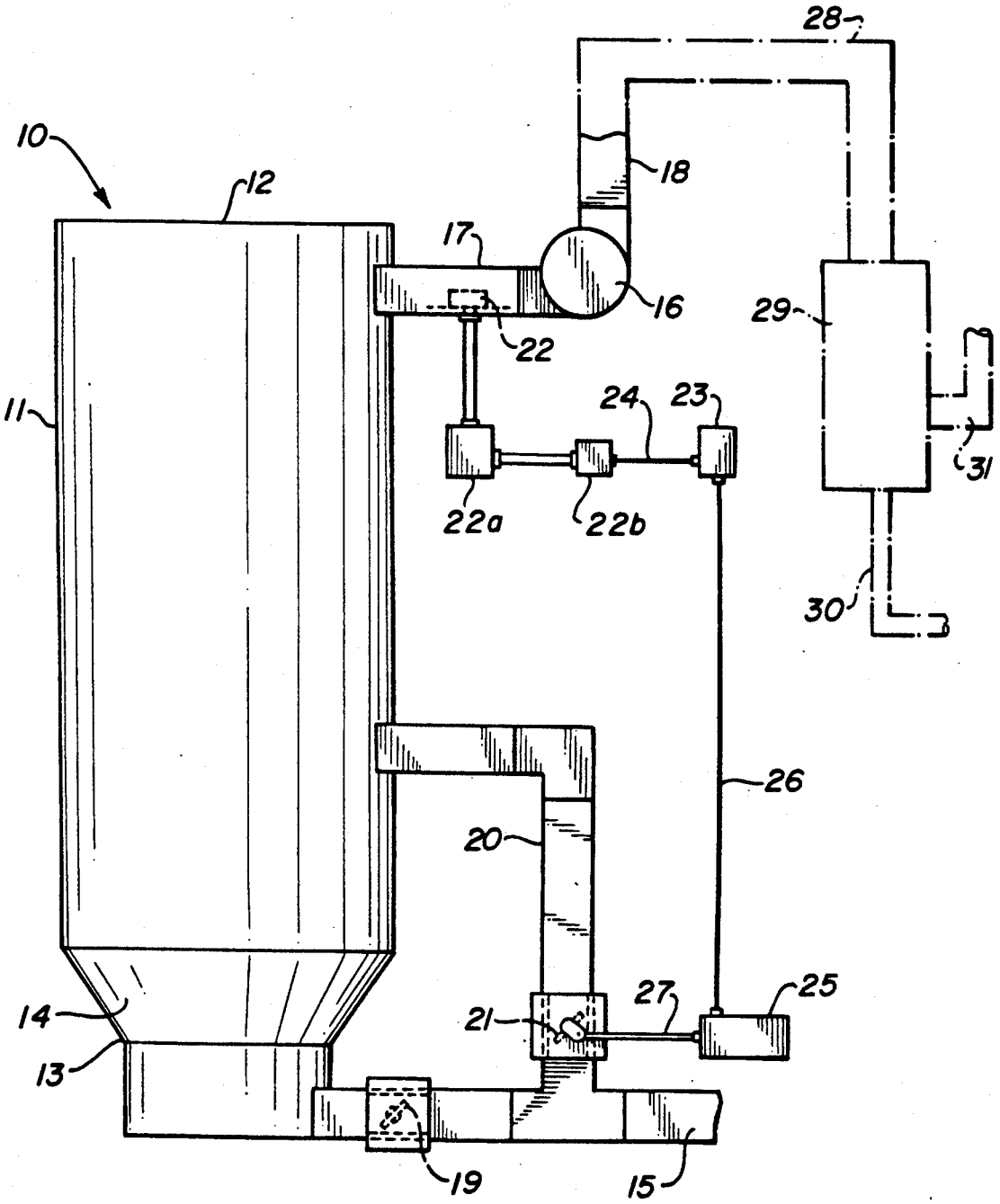
10
11
12
13
14
15
16
17
18
19
20
21
22
22a
22b
23
24
25
26
27
28
29
30
31

METHOD AND ASSEMBLAGE FOR CONTROLLING AND MANAGING LOWER EXPLOSION LEVELS

BACKGROUND OF THE INVENTION

This invention is directed toward a method and an assemblage for controlling and managing the lower explosion level (LEL) in ovens or furnaces where a potentially explosive or combustible atmosphere can be created. The ovens or furnaces with which the method and assemblage of the invention can be used typically utilize ambient or heated air and are operated at about atmospheric or slightly negative pressure to process or dry products that contain potentially explosive or combustible volatile materials. For example, such ovens or furnaces are used to dry paints, powders, pharmaceutical formulations, and the like. They are also used in finishing processes which include dipped, coated, sprayed and impregnated materials or wood, paper and plastic pallets, spacers or packaging materials. In addition, these ovens and furnaces are employed in polymerization and resin curing processes. Potentially explosive or combustible materials that my be present in these processing and drying operations include quench oil, waterborne finishes, cooling oil, aromatics such as alcohols, organic solvents, and the like.

The National Fire Protection Agency (NFPA) has classified such ovens and furnaces as "Class A" and has established standards for their ventilation. These standards state that the LEL in Class A ovens and furnaces must not exceed 50% and the combustion level must be continuously monitored [See NFPA, *Ovens and Furnaces*, "NFPA 86 Standard for Ovens and Furnaces", 1985 Edition]. Many industrial insurers have adopted the NFPA standards for Class A ovens and furnaces in their policies.

Lower explosion level (LEL) is generally accepted to mean the lowest ratio of an explosive or combustible material to air at which the material will explode or combust. In other words, it is that concentration of an explosive or combustible material present in air at which the material will explode or combust.

In order to avoid a potentially dangerous explosive or combustible condition, many products containing volatile aromatics or solvents are dried on open trays or beds in large, enclosed areas at about ambient temperatures. These products are periodically, manually stirred in order to expose more of their surfaces as they are air-dried so that the volatile aromatices or solvents contained in them can slowly evaporate into the air. This type of open bed or tray drying is cumbersome, time consuming and labor intensive. By employing the method and assemblage of this invention, these products can now be safely, quickly and economically dried in Class A ovens or furnaces.

SUMMARY OF THE INVENTION

It has now been found that the LEL in ovens or furnaces where a potentially explosive or combustible atmosphere can be created can be managed and controlled by the method and assemblage of this invention. In general, the method and assemblage of the invention comprises means for controlling combustible levels by concurrently supplying primary air and supplemental air to an oven or furnace; means for controlling the rate at which said priamary air is supplied so that it initially comprises from about 0% to about 25% of the total volume of air supplied to said oven or furnace; means for controlling the rate at which said supplemental air is supplied so that it initially comprises from about 75% to about 100% of the total volume of air supplied to said oven or furnace; and, means for increasing the rate which said primary air is supplied and concurrently decreasing the rate at which said supplemental air is supplied until the total volume of air supplied to said oven or furnace comprises primarily said primary air such that the lower explosion level within said oven or furnace during the entire time said primary air and said supplemental air are being supplied is maintained at an acceptable level.

For most drying and processing operations, the initial flow rates of the concurrently supplied primary air and supplemental air are maintained at their respective levels for a period of from about 5 minutes to about 10 minutes before increasing the flow rate of the primary air and decreasing the flow rate of the supplemental air. The total volume of primary air and secondary air used in typical drying and processing operations is from about 6,000 to about 6,500 cubic feet per-minute (CFPM) for an oven or furnace having a capacity of from about 700 to about 850 liters. However, these initial time rates and total air volumes can be varied as required depending upon the material processed or dried and the capacity of the oven or furnace used.

In typical Class A ovens and furnaces, the product to be processed or dried is charged to the oven or furnace and air is drawn through the product by means of a blower. In the method and assemblage of the invention, the supplemental air is introduced into the oven or furnace at a point downstream from the entry point of the primary air.

During the entire processing or drying period, the LEL in the furnace or oven can be monitored continuously and on-line by using conventional sensing devices to measure the concentration of the potentially explosive or combustible material present in the atmosphere within the furnace or oven. As the LEL decreases, the primary air flow rate is increased and the supplemental air flow rate is decreased until mainly primary air is being supplied. It should be noted that as an added precaution it is preferred to continuously supply some supplemental air throughout the process to ensure a quicker response time in the event of a process upset which could result in raising the combustible level later in the process.

For drying and processing operations conducted in these Class A ovens or furnaces that involve volatile aromatics or solvents, the most critical time to control the LEL is when the drying or processing begins for it is at this time that the atmosphere within the furnace or oven can reach or exceed 100% thereby presenting a potentially dangerous explosive or combustible condition. Therefore, when volatile aromatics or solvents are involved in these drying or processing operations, it is preferred to maintain the LEL at a level no greater than about 50% thereby controlling a potentially dangerous explosive or combustible condition within acceptable and safe limits.

DETAILED DESCRIPTION OF THE INVENTION

The method and assemblage of the invention will become more apparent and will be readily understood by those skilled in the art from the ensuing description when considered together with the accompanying drawing wherein the sole FIGURE is an elevation view illustrating one embodiment by which the method and assemblage of the invention can be employed with an oven or furnace.

As shown in the drawing, a conventional oven or furnace, generally identified by reference numeral 10, typically has a vertically mounted, cylindrical body 11 with a closed top 12 and a frustoconical bottom 13 which contains suitable means for receiving the product to be dried or processed; e.g., a product bowl, as indicated by reference numeral 14. Ambient or pre-warmed air, such as air pre-warmed up to about 60° C., is supplied to the oven or furnace 10 through its frustoconical bottom 13 by means of air supply conduit 15. The air is pulled through the product placed in the product bowl 14 and through body 11 by means of a conventional blower or air pump 16 and associated conduit 17 which communicates with the interior of body 11 adjacent its top 12. The air thus circulated through the oven or furnace 10 is then normally exhausted to the atmosphere from air blower or pump 16 through exhaust conduit 18. Air supply conduit 15 can be provided with a damper valve 19 to regulate and control the flow rate of the air being supplied. Where desired or required air supply conduit 15 can also be provided with conventional screens or filters (not shown) to insure that the air being supplied is relatively free from dust, odors, and the like.

In the method and assemblage of the invention, a supplemental air supply conduit 20 is provided to communicate at one end with air supply conduit 15 and at its other end with the interior of body 11 downstream from product bowl 14. With the inclusion of supplemental air supply conduit 20, air supply conduit 15 becomes the primary air supply conduit in the method and assemblage of the invention. Supplemental air supply conduit 20 is also provided with a damper valve 21 to regulate and control the flow rate of supplemental air supplied to the interior of oven or furnace 10. While not critical, it is preferred that the point at which supplemental air supply conduit 20 enters to communicate with the interior of body 11 be positioned closely above the height of that quantity of product normally charged to the product bowl 14 for processing or drying. Supplemental air is delivered into body 11 so that its air flow is dispersed from its delivery point across the entire cross sectional area of body 11.

A probe 22 is positioned within conduit 17 to monitor the LEL content of the air being discharge from body 11. Samples of exhaust air are periodically pulled through probe 22 by means of a sampling pump **22*a* to and delivered to LEL monitor 22*b*. Conventional LEL monitors and probes that are commercially available can be employed for this purpose such as infra red analyzers, catalytic sensors, flame ionization detectors, and the like. Monitor 22*b* is electrically connected to a controller 23 by means of electrical conduit 24 and pneumatically connected to an actuator 25 by means of conduit 26. Actuator 25 is, in turn, mechanically connected to supplemental air damper valve 21 by means of rod 27. Upon receipt of a signal from controller 23, actuator 25 is activated to open or close damper valve 21 through rod 27 to thus regulate and control the flow rate of supplemental air into the body 11 of the oven or furnace 10 through supplemental air conduit 20**. A typical, commercially available controller that can be employed in this assemblage is the Universal Digital Controller (UDC 5000) manufactured by Honeywell.

A suitable actuator 25 that can be used for this purpose is a commercially available compressed air cylinder which, when activated by an pneumatic signal from controller 23, pneumatically moves arm 27 to open or close damper valve 21.

As noted earlier, the exhaust air containing the entrained, volatile or combustible material is currently typically exhausted to the atmosphere through exhaust conduit 18. In a further embodiment of the method and assemblage of the invention, this exhaust air can be recaptured and the volatile or combustible material entrained therein can be recovered for future use. Recapture and recovery of the exhaust air can be accomplished by fitting exhaust conduit 18 to a recovery conduit 28 through which the exhaust air is conveyed to a suitable scrubber/condensor housing 29. Entrained volatile or combustible material is extracted from the exhaust air in the scrubber/condensor housing 29 and the thusly recovered volatile or combustible material is delivered from scrubber/condensor housing 29 through delivery conduit 30 to a suitable receptacle while the cleaned exhaust air is vented from the scrubber/condensor housing 29 through vent conduit 31.

By providing this recapture and recovery means, the exhaust air ultimately vented to the atmosphere is virtually free from entrained volatile or combustible materials thereby contributing to an ecologically healthier atmosphere. In addition, the volatile or combustible materials recovered can be used again thereby providing a more economical operation.

In a typical operation, product containing volatile or combustible material that is to be dried or processed is charged to product bowl 14, damper valve 21 is fully opened and damper valve 19 is only cracked open. At this point, volatile or combustible material present in the product begins to evaporate in body 11. Blower or air pump 16 draws ambient air via conduits 15 and 20 through conduit 17 and body 11 at a total rate of from about 6,000 CFPM to about 6,500 CFPM. Once the LEL has stabilized, damper valve 19 is opened to permit free flow of primary air.

Since the product is normally wet with volatile or combustible material at this time, it is dense and has a tendency to pack thereby constricting air being fed to it through conduit 15 from passing upwardly through it. Consequently, the supplemental air being supplied through conduit 20 not only captures the evaporating volatile or combustible material and quickly removes it from body 11 through exhaust conduit 18, but this supplemental air flow also dilutes the concentration of volatile or combustible material present in it and maintains its concentration at or below the desired or required LEL.

With minimal primary air being supplied at the outset of processing, the LEL concentration in body 11 will drop. As the LEL drops below the setpoint established in the controller 23, the controller 23 activates actuator 25 to begin closing valve 21. This serves to reduce supplemental air flow while concurrently increasing primary air flow through the product. As a result, more combustible material is withdrawn from the product raising the LEL back to the setpoint in the controller 23. This sequencing continues until damper valve 21 is almost completely closed so that mainly primary air is being conveyed through the product by conduit 15 for that amount of time sufficient to completely dry or process all of the product charged to the product bowl 14. The thusly dried or processed product is then removed from the product bowl in preparation for the next product charge.

Although the method and assemblage of the invention has been described in some detail and with particularity, it will become apparent to those skilled in this art that changes and modifications can be made therein without departing from the scope and spirit of the invention.

What is claimed is:

1. An assemblage for controlling and managing the lower explosive level in an oven or furnace used to dry or process products containing a volatile or combustible material, said assemblage comprising:

(a) an oven or furnace having a closed upper end, a lower end having a receptacle adapted to receive a charge of product containing a volatile or combustible material therein and side walls interconnecting said upper and lower ends defining an oven or furnace body therebetween;

(b) a primary air conduit equipped with a valve means and communicating with said lower end through which a primary supply of air is conveyed through a product charge contained in said receptacle;

(c) conduit means communicating at one end with said body adjacent said closed upper end and connected to an air pump or blower at its other end;

(d) an exhaust conduit secured to said air pump or blower for exhausting air removed from said body into the atmosphere;

(e) a supplemental air conduit equipped with a valve means and communicating at one end with said body intermediate said upper end and said receptacle and communicating at its other end with said primary air conduit and through which a supplemental supply of air is delivered into said body;

(f) sensing means within said communicating conduit for monitoring the concentration of said volatile or combustible material present in the air conveyed through said communicating conduit; and, (g) regulating and control means interconnected with said sensing means and said supplemental air conduit to control and regulate the rate at which air is conveyed through said primary and supplemental air conduits such that the lower explosive limit of said volatile or combustible material within said body is maintained at or below a predetermined level.

2. The assemblage of claim 1 wherein said regulation and control means include a controller and an actuator, said controller being electrically interconnected to said sensing means and pneumatically connected to said actuator and said actuator being mechanically connected to said supplemental air conduit valve such that upon receipt of a signal from said controller, said acutator is activated to open or close said supplemental air conduit valve.

3. The assemblage of claim 1 which includes a scrubber/condensor means; a conduit for conveying exhaust air containing said volatile or combustible material from said exhaust conduit to said scrubber/condensor means; means for collecting said volatile or combustible material recovered from said scrubber/condensor means; and, means for venting air to the atmosphere from said scrubber/condenser means that is substantially free from said volatile or combustible material.

4. A method for controlling and managing the lower explosion level in an oven or furnace used to dry or process products containing a volatile or combustible material, said method comprising:

(a) charging an oven or furnace with a product to be dried or processed therein, said product containing a volatile or combustible material;

(b) supplying a flow of primary air to said oven or furnace at a point below that where said product charge is located in said oven or furnace;

(c) concurrently supplying a flow of supplemental air to said oven or furnace at a point above that where said product charge is located in said oven or furnace;

(d) concurrently controlling the rate of flow of said primary air and said supplemental air so that the volume of primary air initially supplied to said oven or furnace comprises from about 0% to about 25% of the total volume of air being supplied and the volume of supplemental air initially supplied to said oven or furnace comprises from about 75% to about 100% of the total volume air of being supplied such that the lower explosion level in said oven or furnace is not exceeded.

5. The method of claim 4 wherein the rate at which said primary air is supplied is increased and the rate at which said supplemental is supplied is concurrently decreased until the volume of air supplied to said oven or furnace consists substantially of said primary air.

6. The methods of claim 4 wherein said supplemental air is supplied to said oven such that it is dispersed from its point of entry across substantially the entire cross sectional area of said oven.

* * * * *